US005958153A

United States Patent [19]

Sakamoto et al.

[11] Patent Number: 5,958,153

[45] Date of Patent: Sep. 28, 1999

[54] FE-SYSTEM AMORPHOUS METAL ALLOY STRIP HAVING ENHANCED AC MAGNETIC PROPERTIES AND METHOD FOR MAKING THE SAME

[75] Inventors: Hiroaki Sakamoto, Kawasaki; Yuichi Sato, Futtsu; Toshio Yamada, Kawasaki, all of Japan

[73] Assignee: Nippon Steel Corporation, Tokyo, Japan

[21] Appl. No.: 08/632,374

[22] Filed: Apr. 10, 1996

[30] Foreign Application Priority Data

| | | | |
|---|---|---|---|
| Apr. 11, 1995 | [JP] | Japan | 7-085476 |
| Jul. 27, 1995 | [JP] | Japan | 7-191926 |
| Dec. 20, 1995 | [JP] | Japan | 7-332340 |
| Jan. 24, 1996 | [JP] | Japan | 8-010066 |

[51] Int. Cl.[6] ..... H01F 1/153

[52] U.S. Cl. ..... 148/304; 336/234

[58] Field of Search ..... 148/304, 403; 336/234

[56] References Cited

U.S. PATENT DOCUMENTS

| | | | |
|---|---|---|---|
| 4,587,507 | 5/1986 | Takayama et al. | 148/403 |
| 4,637,843 | 1/1987 | Takayama et al. | 148/403 |

FOREIGN PATENT DOCUMENTS

| | | | |
|---|---|---|---|
| 1174081 | 9/1984 | Canada | 148/304 |
| 51-73920 | 6/1976 | Japan . | |
| 57-137451 | 8/1982 | Japan . | |
| 57-185957 | 11/1982 | Japan . | |
| 57-193005 | 11/1982 | Japan | 148/304 |
| 57-193006 | 11/1982 | Japan | 148/304 |
| 58-91155 | 9/1983 | Japan . | |
| 59-16947 | 1/1984 | Japan . | |

*Primary Examiner*—John Sheehan
*Attorney, Agent, or Firm*—Kenyon & Kenyon

[57] ABSTRACT

An amorphous metal alloy strip having enhanced magnetic properties consisting essentially of a composition mainly composed of Fe, Si, B, C and P having the formula $(Fe_aSi_bB_cC_d)_{100-x}P_x$, wherein "a", "b", "c" and "d" are atomic percentages ranging from 70 to 86, 1 to 19, 7 to 20 and 0.02 to 4, respectively, with the proviso that the sum of "a", "b", "c" and "d" is equal to 100, and "x" is a weight percentage ranging from 0.003 to 0.1, said alloy strip having a thickness of 40 to 90 $\mu$m and a width of not less than 20 mm. This amorphous metal alloy strip can be produced by a sinle-roll or twin-roll process under a specific cooling condition.

4 Claims, No Drawings

FE-SYSTEM AMORPHOUS METAL ALLOY STRIP HAVING ENHANCED AC MAGNETIC PROPERTIES AND METHOD FOR MAKING THE SAME

BACKGROUND OF THE INVENTION

1. Field of the Invention

The present invention relates to amorphous metal alloy compositions, and, in particular, to Fe-system amorphous metal alloy strips containing iron, silicon, boron , carbon and phosphorus, having enhanced AC magnetic properties for use in electric power transformer cores and high frequency transformer cores.

2. Description of the Prior Art

The need has been recognized for processes such as processes, melt-spin single roll processes or twin roll processes etc, which permit manufacture of finished or semi-finished products such as wire,ribbon or sheet directly from the molten metal. These processes involve rapid quenching of a jet of molten metal from an orifice directed against a moving chill surface, such as the inside or outside of a rotating roll. It also has become apparent that certain amorphous metal strip materials may posses magnetic and physical properties that enhance their usefulness as materials in various applications by proper selection of the alloy compositions.

Amorphous metal alloy strips shows great promise as industrial materials in various uses because of their superior characteristics. Alloy compositions for strip material for use in electric power transformers and high frequency transformers having a Fe—Si—B system alloy is especially well established because it shows low core loss, high magnetic flux density and high permeability.

It is known, however, that when such a metal alloy strip is continuosly cast, a raw material whose content of impurities is extremely limited is used to avoid increasing core loss. Electrolytic iron is used as a raw material. The impurity elements whose concentration should be restricted are,for example phosphorus and sulfur. Japanese Unexamined Patent Publication No.59-16947 discloses amorphous metal alloy compositions consisting essentially of 86 to 95% of Fe, 0–11% of Si, 2–4% of B and 0–1.5% of C, by weight %, which converted to an atomic percentages are 65.9–85.4% of Fe, 0–18.3% of Si, 8.3–17.6% of B and 0–6.1% of C respectively, and further containing not more than 0.015 wt % of P and not more than 0.02 wt % of S, and describes that P is an element which increases core loss and S is an element increasing brittleness. Relating to the process conditions only disclosed in this patent publication, there is no specific description other than a quenching rate of more than $10^5$~$10^{6°}$ C./sec and the strip having a thickness of about 30 μm in the Examples.

Japanese Unexamined Patent Publication No.57-137451 discloses amorphous metal alloy containing a maximum allowable amount of impurities, such as not more than 0.008% of P, not more than 0.12% of Mn and not more than 0.02% of S , by atomic percentages. This amorphous metal alloy composition consists essentially of 78.5%–80% Fe, 5–10% Si and 13–16% B, by atomic percentages. Therefore, the amount of the above mentioned P, Mn and S, converted to weight %, are not more than 0.053% of P, not more than 0.14% of Mn and not more than 0.0136% of S, respectively. These impurities such as P, Mn and S, as disclosed, are harmful elements which increase core loss.

Composition design of amorphous metal alloys containing a low amount of harmful impurities,i.e. P, Mn and S has been carried out to decrease core loss. However, the following prior art shows that P can be used advantageously.

Japanese Unexamined Patent Publication No.57-185957 discloses an amorphous metal alloy strip containing 1 to 10 atomic % of P in a Fe—Si—B—C—P system alloy to reduce core loss and improve magnetic flux density. However, this patent publication also discloses as an additional condition a content of at least one element selected from Al, Sn, Ge, Ti, Zr, Nb, V, Mo or W in an amount of not more than 5 atomic %.

Japanese Patent Publication No.58-42261 discloses amorphous metal alloy strip containing not less than 5 atomic % of P in a Fe—Cr—C—P system alloy and Fe—Cr—B—P system alloy for improving the tensile strength and heat resistance.

Japanese Unexamined Patent Publication No.51-73920 discloses amorphous metal alloy strip containing only 7 to 35 atomic % of P in a Fe—Si—B—C—P system alloy for increasing magnetic flux density.

As evident from the above, no amorphous metal alloy strip, or its production process, has been found which contains only P in a Fe—Si—B—C system alloy to decrease core loss. Furthermore, it is difficult to use the iron materials produced by an ordinary steel making process from iron ore as a material for production of an amorphous metal alloy strip, because the allowable range of impurities is very narrow in for production of a Fe—Si—B—C system amorphous metal alloy strip, because an ordinary steel material contains an amount of impurities exceeding the allowable range.

It is possible to use a high purity material, such as electrolytic iron, because of its reduced range of impurities. On the other hand, use of expensive high purity raw material increases the production cost of the amorphous metal alloy strip. The resultant characteristics considerably vary from lot to lot, and lead to a lower a yield ratio and to increased cost. There has long been a demand to lower the production cost of amorphopus metal alloy strip for its widespread use as an industrial material

SUMMARY OF THE INVENTION

An object of the present invention is to provide a novel amorphous metal alloy strip having reduced core loss and an improved yield ratio using conventional inexpensive materials which contains amount of impurities beyond the allowable range of the product, without using high purity materials such as electrolytic iron.

The present invention provides a novel amorphous metal alloy strip having a thickness of 40 to 90 μm and a width of not less than 20 mm with enhanced magnetic properties. The alloy of the present invention consists essentially of a composition of Fe, Si, B, C, and P having the formula $(Fe_aSi_bB_cC_d)_{100-x}$, wherein "a", "b", "c", and "d" are atomic percentages ranging from 70 to 86, 1 to 19, 7 to 20 and 0.02 to 4, respectively, with the proviso that the sum of "a", "b", "c", and "d" is equal to 100, and "x" is a weight percentage ranging from 0.003 to 0.1 μmore preferably , "x" is about 0.004 to 0.03 weight percent. A method of producing such an amorphous metal alloy strip is provided wherein a) melting a raw alloy containing the above mentioned compositions, b)forcing the molten alloy under the pressure through a slotted nozzle positioned generally perpendicular to the direction of movement of the chill surface, c) advancing the chill surface at a predetermined speed, d) quenching the molten metal in contact with the chill surface at a quenching rate of from $1\times10^{°}$ C./sec to $2\times10^{5°}$ C./sec between the melting point of said alloy and 400° C.

The present invention also provides an amorphous metal alloy strip consisting essentially of an atomic percentages ranging from Si: 1 to 19; B: 7 to 20; and C: 0.02 to 4 as main components and further containing P, Mn and S as impurities in weight percentages ranging from 0.008 to 0.1, 0.15 to 0.5, 0.004 to 0.05, respectively.

A particular objective of the present invention is the identification of an amorphous metal alloy strip having enhanced magnetic properties consisting essentially of a composition of Fe, Si, B, C, and P having the formula $(Fe_aSi_bB_cC_d)_{100-x}$ wherein "a", "b", "c", and "d" are atomic percentages ranging between more than 80 and 82, 2 and less than 5, 14 and 16, and 0.02 and 4, respectively, with the proviso that the sum of "a", "b", "c", and "d" is equal to 100, and "x" is a weight percentage ranging from 0.003 to 0.1, and further containing P, Mn and S as impurities with weight percentages ranging from 0.008 to 0.1 , 0.15 to 0.5, 0.004 to 0.05, respectively.

The present invention provides enhanced magnetic properties of core loss of not more than 0.12 W/kg measured at 50 Hz with 1.3 T (Tesla) in a single cut sheet. More particularly, the amorphous metal alloy strip of the present invention shows core loss of not more than 0.15 according to the formula (Wmax−Wmin)/Wmin, where Wmax is the maximum value of core loss and Wmin is the minimum value of core loss measured at 50 Hz with 1.3 T (Tesla) in a single cut sheet.

DETAILED DESCRIPTION OF THE INVENTION AND PREFERRED EMBODIMENTS

To produce the alloy at low cost, low quality resource containing a certain amount of incidental impurities can be used as a material for the production of amorphous metal alloy. Generally, the alloy cost can be reduced by use of low quality materials.

The present inventors investigated the effects of various kinds of impurities in Fe—Si—B—C system alloys at different concentrations of the main components and of the impurities, and found that a reduced core loss can be obtained with a specific content of P and a specific thickness produced by a casting process with a specific quenching rate. After making the above findings, the present inventors conducted further research relating to the effect of P in a Fe—Si—B—C system alloy which contained various kinds of impurities simultaneously, and found that the resultant properties do not detriorate when a specific amount of P is contained as an impurity even if other impurities such as Mn and S are contained more than the conventional quantities. Thus, it was discovered that inceased amounts of impurities do not necessarily cause harmful effects. In addition, core loss properties, yield ratio and stability of properties are considerably improved limiting to a narrow range in the respective contents of Fe, Si, B and C, with small amounts of P,Mn and S present.

In addition to the above mentioned effects of P, core loss is significantly reduced when a specific quenching rate is applied to a specific alloy composition containing a small amount of P. This phenomenon was found by measurement of the quenching rate determined by a temperature of solidified metal on the casting surface to obtain the amorphous condition during the casting operation. To obtain an amorphous metal alloy strip having improved magnetic properties, in particular, reduced core loss, the content of P should be limited to 0.003 to 0.1 weight %. When the content of P is less than 0.003 weight %, reduced core loss cannot be obtained. On the other hand, when the content of P exceeds 0.1 weight %, core loss is increased. By limiting the concentration of P within the above range, the effects of addition of P can be seen in a strip thickness the between 40 μm and 90 μm. Even if the strip thickness is in the range of 80 μm to 90 μm, improved magnetic properties can be obtained, and a core loss value at W13/50 of not more than 0.15 W/kg at a frequency of 50 Hz with magnetic flux density having 1.3 T (Tesla) can be obtained in a single cut sheet. To obtain a sufficiently reduced core loss at W13/50, of not more than 0.13 W/kg, the amount of P must be limited to the range of 0.004 to 0.03 weight %.

Relating to the strip thickness, the effects of P can be seen only in a thickness of between 40 μm and 90 μm. For a strip having a thickness of less than 40 μm or more than 90 μm, the effects of P cannot be seen clearly. The strip width should be limited to 20 mm in consideration of the productivity.

The main elements such as Fe, Si, B and C in the composition of the present invention contribute to the above mentioned properties. To maximize the magnetic saturation, the amount of iron should be as high as possible. On the other hand, when a large amount of iron is contained, for example more than 86 atomic %, formation of the amorphous state and the requisite magnetic properties cannot be obtained. In particular, the amount of iron must be at least 70 atomic % in order to obtain a magnetic saturation of at least 1.5 T for use in transformer cores. In particular, when P is contained independently in Fe—Si—B—C system alloys , the amount of iron should be limited to 77 to 83 atomic % in order to obtain a stable core loss and a stable productivity. By keeping the iron content below 86 atomic % , the other major constituents, namely Si and B, can be provided in limited amounts. The addition of Si and B is necessary to obtain an amorphous strip having an increased thermal stability and amorphous formation capability. The content of Si and B must be limited to not less than 1 atomic % and 7 atomic % respectively in order to obtain a stable amorphous formation. The upper limits of the contents of Si and B should be 19 atomic % and 20 atomic ° respectively considering the increased cost of using expensive materials, and the lack of further improvement of thermal stability and an amorphous formation capability. It is therefore preferable to limit both the Si and B contents to below 19 atomic % and 20 atomic %. The addition of C also has the effect of increasing castability for amorphous strip casting. Addition of appropriate amount of C can ensure amorphous formation of the amorphous strip because of the increased wettability between the melt and chill surface Therefore, the amount of C must be limited to 0.02 to 4 atomic % in order to obtain the above mentioned effects.

The present inventors also investigated the casting parameters, namely the relationship between the quenching rate and core loss with varied P contents. It was noted that the requisite core loss may be obtained by use of casting methods with an average quenching rate of between $1\times10^{5\circ}$ C./sec and $2\times10^{1\circ}$ C./sec during cooling from the melting point of the molten alloy to 400° C. Therefore, the average quenching rate must be limited to between $1\times10^{1\circ}$ C./sec and $2\times10^{1\circ}$ C./sec in order to obtain core loss value of W13/50 below 0.15 W/kg which is practically useful for transformer cores. A temperature of 400 °( was determined to provide a stable amorphous condition.

To enable the use of an inexpensive raw materials which contains Mn and S in a greater amount more than the conventional allowable ranges, such as 0.15 to 0.5 weight % of Mn and 0.004 to 0.05 weight % of S, the content of P should be limited to the range of 0.008 to 0.1 weight %. It had been previously thought however, that the presence of P had a detrimental effect on various properties. It was surprisingly found that reduced core loss, improved yield ratio and the reduced fluctuation of properties are obtained by limiting in Fe, Si and B to narrow ranges between more than 80 and 82 atomic %, 2 and less than 5 atomic %, and 14 and 16 atomic %, respectively, in a Fe—Si—B system alloy.

The thus obtained amorphous strip shows a core loss value of W13/50 below 0.15 W/kg measured at a frequency of 50 Hz and a magnetic flux density of 1.3 T (Tesla) when the P content is 0.008 to 0.1 weight % even if an inexpensive raw material containing Mn in an amount of 0.15 to 0.5 weight % and S in an amount of 0.004 to 0.05 weight % is used. In case of an Fe—Si—B—(C) system alloy used for transformer cores, core loss should be as low as possible. It is preferable to ensure core loss value of W13/50 below 0.15 W/kg to make use of the inherent amorphous characteristics of the metal. When the P content is less than 0.008 weight %, allowable ranges of the impurities of Mn and S become narrower, and the core loss value of W13/50 below 0.12 W/kg cannot be achieved. When the P content is more than 0.1 weight %, no further improvement of the allowable ranges of the impurities of Mn and S appear. Therefore, the P content must be limited to the range of 0.008 to 0.1 weight %. In order to optimally expand the allowable ranges of the impurities of Mn and S, the P content should be limited to a range of 0.01 to 0.03 weight %.

With respect to the Mn and S content, a core loss value below 0.12 W/kg cannot be obtained when the Mn content exceeds 0.5 weight % and the S content exceeds 0.05 weight % , even if the proper amount of P, for example 0.008 to 0.1 weight % is contained. Accordingly, the Mn and S contents should be limited to not more than 0.5 weight % and 0.05 weight %, respectively. On the other hand, if the respective contents of Mn and S are below 0.15 weight % and 0.004 weight %, a conventional expensive and high purity raw material has to be used even if the cost is increased. It is preferable that the contents of the impurity elements, particularly Mn and S, be as low as possible within the above mentioned limited ranges, such as 0.15 to 0.3 weight % of Mn and 0.004 to 0.02 weight % of S.

The present inventors also discovered that a core loss value of W13/50 below 0.12 W/kg is obtained when the content range of each of Fe, Si, B and C as a main component is narrowed to suitable values in the amorphous metal alloy containing impurities such as P, Mn and S. It was also discovered that the amorphous metal alloy strip has uniform properties throughout in the lengthwise direction in one lot when following formula is satisfied: $(Wmax-Wmin)/Wmin \leqq 0.15$, where Wmax is the maximum value of the core loss. The above mentioned amorphous metal alloy strip having a uniform structure can be obtained by the limiting the contents of Fe , Si, B and C to specific ranges in order to increase the amorphous formation capability and provide more stability. For an alloy having not less than 70 atomic % of iron, a practical level of magnetic saturation for use in transformer cores is obtained. In order to obtain a high level of magnetic saturation of not less than 1.6 T, the iron content must exceeds 80 atomic %. However, if the iron content exceeds 86 atomic %, the requisite amorphous condition cannot be obtained. To consistently attain a stable amorphous condition, the iron content is below 82 atomic %. Therefore, the iron content should be limited to the range between more than 80 and 82 atomic %.

The requisite amorphous condition is obtained when the alloy has the Si content greater than 1 atomic % and the B content greater than 7 atomic %. On the other hand, when the Si content less than 2 atomic % and the B content less than 14 atomic % respectively, the formula ; $(Wmax-Wmin)/Wmin \leqq 0.15$ cannot be satisfied. Using a raw material containing impurities in the alloy of the present invention, when the Si content becomes not less than 5 atomic %, the limitation $(Wmax-Wmin)/Wmin \leqq 0.15$ cannot be satisfied. Furthermore, when the B content exceeds 16 atomic %, brittleness occurs because of the use of a raw material containing impurities, and the production cost increases. Therefore, the Si and B contents must be limited to the narrower ranges between 2 and less than 5 atomic %, and between 14 and 16 atomic %, respectively.

As described above, it was formerly thought that reduced core loss could be obtained only by using expensive high purity raw materials. On the contrary, the present invention can achieve a superior core loss of W13/50 below 0.12 W/kg, even if a large amount of impurities is ontained in the raw materials. Furthermore, the thus obtained amorphous alloy metal strip shows a stable amorphous condition having $(Wmax-Wmin)/Wmin \leqq 0.15$ uniformly throughout in the lengthwise direction in one lot by limiting to a narrow range of the Fe, Si, B and C contents. As a result, an increased yield ratio is achieved and the alloy cost and the cost of strip itself can be reduced.

The following explains how to determine the alloy composition for prodution of an amorphous metal strip. In order to determine the effect on the improvement of core loss of P, while keeping the production condition such as quenching rate, the strip thickness, and other components constant, is referred to "the first order effect of P", the respective amounts of Fe, Si, B and C by atomic % are determined. In addition to the above first order effect of P, the effect on expansion of the allowable ranges of impurities while keeping more narrow ranges of the Fe, Si, B and C contents, is referred to as "the second order effect of P", was determined. A detail contents of P, Mn, and S in the inexpensive raw materials containing a large amount of impurities against thus already determined to the respective amounts of Fe, Si, B and C, by atomic % are 0.008 to 0.1 weight % of P, 0.15 to 0.5 weight % of Mn and 0.004 to 0.05 weight % of S, in order to satisfy the present invention. Preferable alloy composition are $Fe_{ba1}Si_{6.5}B_{12}C_1$. $Fe_{ba1}Si_{6.0}B_{15}C$, $Fe_{ba1}Si_{3.5}B_{15}C_1$. $Fe_{ba1}Si_{3.3}B_{15.5}C_1$ and $Fe_{ba1}Si_{2.2}B_{15.1}C_1$.

It is possible to use as a raw material the alloy which is obtained by the ordinary steel making process using iron ore in the present invention. However, the present invention is not limited to this raw material.

To obtain the strip of the present invention which has the above composition the alloy must be melted and rapidly cast from the melt to the solid state by means of a single-roll process or a twin-roll process. More particularly, a molten alloy is forced under pressure through a slotted nozzle positioned generally perpendicular to the direction of the movement of chill surface advancing at a predetermined speed, and quenching the molten metal in contact with the chill surface at a specific quenching rate, such as from $1\times10^{1\circ}$ C./sec to $2\times10^{5\circ}$ C./sec between the melting point of said alloy and 400° C.

Casting machine used for the single-roll process can include a melt-spin casting machine wherein the molten metal is supplied by ejecting it to the inside of the rotating chill surface, a continuous belt type machine or other modified machine with supporting roll or roll temperature mesuring systems. The casting operation is carried out at reduced pressure, in a vacuum or in an inert gas atomosphere . Relating to the strip thickness and width, it is preferable to have a thickness within the range of about 10 to 100 μm and at least 20 mm wide. If a thick strip is desired, it is possible to supply it by a process using a multi-slotted nozzle, which is disclosed in Japanese Unexamined Patent Publication No.60-255243. Using this process, a thick strip having a thickness of more than 40 μm can be easily obtained. Measuring the quenching velocity of a strip during casting can be carried out by means of a contact thermometer which is disclosed in Japanese Unexamined Patent Publication No.59-64144. According to this process, the average quenching velocity between just under the melting point and 400° C. is easily measured. Alternatively, a radiant thermometer is also available.

As described above, a low quality raw material can be used for the amorphous alloy according to the present invention. As a result, an increased yield ratio is achieved the alloy production cost and the cost of the strip itself can be reduced. Furthermore, a thick amorphous metal strip having superior magnetic properties can be easily obtained without using a complicated casting machine or high level technology, even if the quenching velocity is relatively small. This leads to further reducing the production cost.

The present invention will now be described in detail with reference to the following examples, which are not meant to limit the scope of the invention.

EXAMPLE 1

The alloys having the composition $Fe_{80.5}Si_{6.5}B_{12}C_1)_{100-x}P_x$, where x was varied from 0.003 to 0.1 weight %, were cast into an amorphous strip having 25 mm width by the single-roll process. The nozzles were a single slotted nozzle having 0.4 mm width and 25 mm length, and a double and a triple slotted nozzle having a 0.4 mm width, 25 mm length and lmm slit space therebetween. The molten alloys having the above composition were ejected from the above nozzle to the chill surface of the rotating Cu roll having a 580 mm diameter. The rotational speeds of the chill roll was 500 to 800 rpm. Thus obtained strips had thicknesses in the ranges from 25 to 95 μm. Then, the strips were annealed in an $N_2$ gas atomosphere at a magnetic field at a temperature of about 360° C. for 1 hour, and then the magnetic properties were measured by the SST measuring process, where SST means "Single Strip Tester".

The comparative alloys, where x was varied less than 0.003 weight % and more than 0.015 weight %, respectively, were cast and annealed in the same way as above, then their magnetic properties were measured.

The resultant products exhibited the core loss values shown in Table 1. As clearly shown in Table 1, a more than 5% reduction core loss was obtained compared with the products with a P content below the limitations of measurement over a range of a thicknesses from 40 to 90 μm and the P content between 0.003 and 0.1 weight % (enclosed by bold lines in the table), considered at the same thickness. On the other hand, the products with P contents between 0.004 and 0.03 weight % (enclosed by double lines in the table) show further reduced core loss; a more than 10% reduction of core loss was obtained compared with products having a P content below the limitations of measurement considered at the same thickness.

TABLE 1

| P content (wt %) | Strip thickness (μm) | | | | | | | | |
|---|---|---|---|---|---|---|---|---|---|
| | 25 | 30 | 40 | 50 | 60 | 70 | 80 | 90 | 95 |
| Below a limitation measurement | 0.124 | 0.127 | 0.129 | 0.131 | 0.132 | 0.137 | 0.145 | 0.152 | 0.170 |
| 0.003 | 0.126 | 0.129 | 0.125 | 0.124 | 0.123 | 0.122 | 0.125 | 0.133 | 0.178 |
| 0.004 | 0.127 | 0.132 | 0.115 | 0.118 | 0.114 | 0.103 | 0.110 | 0.127 | 0.180 |
| 0.01 | 0.130 | 0.136 | 0.115 | 0.117 | 0.113 | 0.105 | 0.113 | 0.125 | 0.185 |
| 0.03 | 0.135 | 0.143 | 0.116 | 0.118 | 0.114 | 0.120 | 0.127 | 0.129 | 0.193 |
| 0.05 | 0.140 | 0.148 | 0.120 | 0.121 | 0.118 | 0.127 | 0.132 | 0.140 | 0.194 |
| 0.1 | 0.145 | 0.151 | 0.122 | 0.123 | 0.123 | 0.130 | 0.137 | 0.144 | 0.210 |
| 0.15 | 0.160 | 0.161 | 0.140 | 0.145 | 0.144 | 0.147 | 0.150 | 0.168 | 0.230 |

EXAMPLE 2

The alloys having the composition $Fe_{80.5}Si_{6.5}B_{12}C_1)_{100-x}P_x$, where x was varied from 0.003 to 0.1 weight %, were cast into amorphous strips by the 5 single-roll process. The nozzles were a single slotted nozzle having a 0.4 mm width, and a double and a triple slotted nozzle having a 0.4 mm width and lmm slit space therebetween. The molten alloys having the above composition were ejected from the above nozzle to the chill 10 surface of the rotating Cu roll having a 580 mm diameter.

The rotational speeds of the chill roll was 500 to 800 rpm. During casting, the strip surface temperature was detected and converted to a quenching rate by a contact thermometer. Then, the strip were annealed in an $N_2$ gas atomosphere in magnetic field at a temperature of about 360° C. for 1 hour, and then magnetic properties were measured by the SST measuring process.

The comparative alloys, where x was varied less than 0.008 weight % and more than 0.1 weight %, respectively, were cast and annealed as the same way as in Example 1, and then their magnetic properties were measured.

The quenching rate calculated from the actual measured value and the core loss value thus obtained are shown in Table 2. The quenching rate means the average quenching rate between a temperature from just below the melting point and 400° C. The core loss value is for 1.3 T at 50 Hz.

As clearly shown in Table 2, a more than 5% reduction of core loss was obtained compared with the products with P contents below the limitations of measurement over a range of quenching rate at least $1\times10^{5°}$ C./sec and below $2\times10^{5°}$ C./sec and P contents between 0.003 and 0.1 weight %

(enclosed by bold lines in the table), considered at same quenching rate. On the other hand, the products with P contents between 0.004 and 0.03 weight % (enclosed by double lines in the table) show a further reduced core loss; a more than 10% reduction of core loss was obtained compared with products having P contents below the limitations of measurement, considered at the same quenching rate.

As clearly shown by Examples 1 and 2, the core loss properties are remarkably improved by the addition of a small amount of P at a specific quenching rate and a specific strip thickness.

TABLE 2

| P content (wt %) | Quenching rate (× $10^5$ ° C./sec) | | | | | | | |
|---|---|---|---|---|---|---|---|---|
| | 0.9 | 1 | 1.2 | 1.4 | 1.6 | 1.8 | 2 | 2.1 |
| Below a limitation measurement | 0.160 | 0.145 | 0.142 | 0.140 | 0.138 | 0.135 | 0.131 | 0.130 |
| 0.003 | 0.163 | 0.130 | 0.125 | 0.122 | 0.116 | 0.124 | 0.120 | 0.133 |
| 0.004 | 0.170 | 0.125 | 0.121 | 0.118 | 0.103 | 0.119 | 0.117 | 0.137 |
| 0.01 | 0.175 | 0.119 | 0.110 | 0.105 | 0.112 | 0.117 | 0.117 | 0.139 |
| 0.03 | 0.182 | 0.120 | 0.115 | 0.113 | 0.120 | 0.121 | 0.120 | 0.141 |
| 0.05 | 0.188 | 0.127 | 0.120 | 0.125 | 0.123 | 0.127 | 0.124 | 0.143 |
| 0.1 | 0.196 | 0.135 | 0.133 | 0.130 | 0.128 | 0.128 | 0.125 | 0.149 |
| 0.15 | 0.210 | 0.151 | 0.140 | 0.132 | 0.137 | 0.133 | 0.138 | 0.158 |

EXAMPLE 3

Amorphous strips were produced from the alloys having the composition Fe—$B_{12}Si_{6.5}C_1$(atomic %) and the balance comprising impurities, by the single roll process in air. The impurities were the P, Mn and S contained in the alloys. Various kinds of alloys having different compositions were cast for the amorphous strip production. The casting machine for the single roll process was equipped Cu roll having a 580 mm diameter, a power supply for hiqh-frequency induction heating for melting the alloys, a quartz crucible with the slotted nozzle being 0.6 mm wide at the front end portion of the crucible. The rotational speeds of the chill roll was 800 rpm.

Strip of good quality and having good properties were obtained from the all of the alloys. The strips had a thickness about 30 $\mu$m. Chemical analysis was conducted on all of the charges. The charge Nos.1–18 in Table 3 contain certained amounts of impurities.

The strips were then annealed in a nitrogen gas atomosphere in a magnetic field at a temperature of about 360° C. for 1 hour, and then the magnetic properties were measured by the SST measuring process. The resultant magnetic properties are shown in Table 3.

It can be seen that each strip produced from each charge shows respective contents of P, Mn and S in the range of 0.008 to 0.1 weight %, 0.15 to 0.5 weight % and 0.004 to 0.05 weight %, respectively, and shows core loss value of W13/50 having 0.12 W/kg or less.

From the above, it is clear that superior magnetic properties can be obtained by the addition of P in an amount of 0.008 to 0.1 weight %, even if the amount of impurities such as Mn and S exceeds the conventional allowable ranges.

In addition, low quality materials can be used as the alloy raw materials.

TABLE 3

| | Charge No. | Impurities contents (wt %) P | Mn | S | Core loss (W13/50) |
|---|---|---|---|---|---|
| Present invention | 1 | 0.010 | 0.26 | 0.012 | 0.106 |
| | 2 | 0.011 | 0.26 | 0.018 | 0.109 |
| | 3 | 0.011 | 0.35 | 0.026 | 0.113 |
| | 4 | 0.021 | 0.36 | 0.009 | 0.098 |
| | 5 | 0.021 | 0.15 | 0.020 | 0.101 |

TABLE 3-continued

| | Charge No. | Impurities contents (wt %) P | Mn | S | Core loss (W13/50) |
|---|---|---|---|---|---|
| | 6 | 0.020 | 0.40 | 0.041 | 0.116 |
| | 7 | 0.031 | 0.21 | 0.014 | 0.101 |
| | 8 | 0.030 | 0.30 | 0.041 | 0.117 |
| | 9 | 0.029 | 0.47 | 0.015 | 0.112 |
| | 10 | 0.055 | 0.16 | 0.030 | 0.113 |
| | 11 | 0.056 | 0.44 | 0.031 | 0.115 |
| | 12 | 0.056 | 0.25 | 0.048 | 0.116 |
| | 13 | 0.098 | 0.46 | 0.008 | 0.116 |
| | 14 | 0.097 | 0.15 | 0.015 | 0.112 |
| | 15 | 0.018 | 0.48 | 0.030 | 0.113 |
| | 16 | 0.019 | 0.41 | 0.047 | 0.119 |
| | 17 | 0.009 | 0.21 | 0.005 | 0.116 |
| | 18 | 0.008 | 0.15 | 0.004 | 0.118 |
| Comparative | 19 | 0.007 | 0.15 | 0.004 | 0.121 |
| | 20 | 0.110 | 0.15 | 0.005 | 0.132 |
| | 21 | 0.021 | 0.24 | 0.064 | 0.123 |
| | 22 | 0.020 | 0.55 | 0.060 | 0.148 |
| | 23 | 0.018 | 0.56 | 0.018 | 0.138 |
| | 24 | 0.031 | 0.24 | 0.056 | 0.138 |
| | 25 | 0.030 | 0.55 | 0.015 | 0.139 |
| | 26 | 0.054 | 0.60 | 0.014 | 0.131 |
| | 27 | 0.097 | 0.61 | 0.024 | 0.138 |
| | 28 | 0.098 | 0.53 | 0.052 | 0.152 |

EXAMPLE 4

Amorphous strips were produced from alloys having the composition Fe—$B_{15}Si_6C_1$(atomic %) and the balance comprising impurities. The impurities were P, Mn and S contained in the alloys. Various kinds of alloys having different compositions were cast for the amorphous strip production. The processing conditions were the same as those of Example 3.

Strips of good quality and having good properties were obtained from all of the alloys. The strips had a thickness of about 30 μm. Chemical analysis was conducted on all of the charges. The charge Nos.1–18 in Table 4 contained certain amounts of impurities. The magnetic properties were measured for each strip produced from all of charges. The measurement were carried out as in Example 3.

It can be seen that each strip produced from each charge shows respective contents of P, Mn and S in the range of 0.008 to 0.1 weight %, 0.15 to 0.5 weight % and 0.004 to 0.05 weight % respectively, and shows core loss values of W13/50 having 0.12 W/kg or less.

From the above, it is clear that superior magnetic properties can be obtained by the addition of P in an amount of 0.008 to 0.1 weight %, even if the amount of impurities such as Mn and S exceeds the conventional allowable ranges. In addition, low quality materials can be used as the alloy raw materials.

TABLE 4

| Charge No. | | Impurities contents (wt %) P | Mn | S | Core loss (W13/50) |
|---|---|---|---|---|---|
| Present invention | 1 | 0.011 | 0.15 | 0.008 | 0.103 |
| | 2 | 0.011 | 0.16 | 0.015 | 0.107 |
| | 3 | 0.010 | 0.31 | 0.016 | 0.110 |
| | 4 | 0.020 | 0.20 | 0.015 | 0.095 |
| | 5 | 0.021 | 0.21 | 0.010 | 0.098 |
| | 6 | 0.021 | 0.41 | 0.040 | 0.106 |
| | 7 | 0.030 | 0.30 | 0.026 | 0.100 |
| | 8 | 0.030 | 0.49 | 0048 | 0.118 |
| | 9 | 0.031 | 0.48 | 0.015 | 0.113 |
| | 10 | 0.054 | 0.16 | 0.019 | 0.107 |
| | 11 | 0.055 | 0.45 | 0.044 | 0.114 |
| | 12 | 0.056 | 0.46 | 0.029 | 0.119 |
| | 13 | 0.098 | 0.47 | 0.014 | 0.115 |
| | 14 | 0.097 | 0.31 | 0.008 | 0.116 |
| | 15 | 0.018 | 0.49 | 0.020 | 0.108 |
| | 16 | 0.018 | 0.40 | 0.040 | 0.118 |
| | 17 | 0.009 | 0.15 | 0.005 | 0.117 |
| | 18 | 0.008 | 0.16 | 0.004 | 0.119 |
| Comparative | 19 | 0.007 | 0.15 | 0.004 | 0.123 |
| | 20 | 0.109 | 0.15 | 0.004 | 0.134 |
| | 21 | 0.020 | 0.52 | 0.010 | 0.128 |
| | 22 | 0.021 | 0.25 | 0.059 | 0.149 |
| | 23 | 0.019 | 0.55 | 0.060 | 0.154 |
| | 24 | 0.031 | 0.25 | 0.055 | 0.139 |
| | 25 | 0.030 | 0.26 | 0.052 | 0.138 |
| | 26 | 0.053 | 0.54 | 0.014 | 0.132 |
| | 27 | 0.098 | 0.39 | 0.054 | 0.141 |
| | 28 | 0.098 | 0.52 | 0.055 | 0.162 |

EXAMPLE 5

Amorphous strips were produced from the alloys having the composition Fe—$B_{15}Si_{2.5}c_1$(atomic %) and the balance comprising impurities. The impurities were P, Mn and S contained in the alloys. Various kinds of alloys having different compositions were cast for the amorphous strip production. The processing condition used was the same as in Example 3.

Strips of good quality and having good properties were obtained from all of the alloys. The strips had a thickness of about 30 μm. Chemical analysis was conducted on all of charges. The charge Nos.1–18 in Table 5 contained certain amounts of impurities. The magnetic properties were measured for each strip produced from all of the charges. The measurement were carried out as in Example 3.

It can be seen that each strip produced from each charge shows respective amounts of P, Mn and S in the range of 0.008 to 0.1 weight %, 0.15 to 0.5 weight % and 0.004 to 0.05 weight % respectively, and shows core loss values of W13/50 having 0.12 W/kg or less.

From the above, it is clear that superior magnetic properties can be obtained by the addition of P in an amount of 0.008 to 0.1 weight %, even if the amount of impurities such as Mn and S exceeds the conventional allowable ranges. In addition, low quality materials can be used as the alloy raw materials.

TABLE 5

| Charge No. | | Impurities contents (wt %) P | Mn | S | Core loss (W13/50) |
|---|---|---|---|---|---|
| Present invention | 1 | 0.010 | 0.21 | 0.010 | 0.101 |
| | 2 | 0.011 | 0.19 | 0.008 | 0.102 |
| | 3 | 0.011 | 0.20 | 0.018 | 0.106 |
| | 4 | 0.018 | 0.21 | 0.006 | 0.092 |
| | 5 | 0.017 | 0.20 | 0.005 | 0.094 |
| | 6 | 0.020 | 0.39 | 0.021 | 0.106 |
| | 7 | 0.030 | 0.39 | 0.020 | 0.105 |
| | 8 | 0.031 | 0.48 | 0.008 | 0.103 |
| | 9 | 0.030 | 0.49 | 0.047 | 0.115 |
| | 10 | 0.051 | 0.31 | 0.011 | 0.106 |
| | 11 | 0.050 | 0.20 | 0.031 | 0.109 |
| | 12 | 0.053 | 0.49 | 0.048 | 0.114 |
| | 13 | 0.098 | 0.48 | 0.009 | 0.116 |
| | 14 | 0.097 | 0.21 | 0.030 | 0.118 |
| | 15 | 0.018 | 0.48 | 0.036 | 0.117 |
| | 16 | 0.019 | 0.41 | 0.043 | 0.119 |
| | 17 | 0.008 | 0.15 | 0.005 | 0.116 |
| | 18 | 0.008 | 0.16 | 0.004 | 0.115 |
| Comparative | 19 | 0.007 | 0.15 | 0.005 | 0.122 |
| | 20 | 0.105 | 0.15 | 0.004 | 0.130 |
| | 21 | 0.021 | 0.53 | 0.010 | 0.123 |
| | 22 | 0.020 | 0.21 | 0.058 | 0.138 |
| | 23 | 0.019 | 0.55 | 0.059 | 0.149 |
| | 24 | 0.030 | 0.21 | 0.054 | 0.131 |
| | 25 | 0.031 | 0.56 | 0.013 | 0.129 |
| | 26 | 0.051 | 0.54 | 0.013 | 0.130 |
| | 27 | 0.097 | 0.21 | 0.058 | 0.152 |
| | 28 | 0.098 | 0.55 | 0.059 | 0.159 |

COMPARATIVE EXAMPLE 1

The amorphous strip were produced from alloys having the composition Fe—$B_{12}Si_{6.5}C_1$(atomic %) and the balance comprising impurities. The impurities were P, Mn and S contained in the alloys. Various kinds of alloys having different composition were cast for the amorphous strip production. The processing conditions were the same as in Example 3. The strip have a thickness about 30 μm. Chemical analysis was conducted on all of charges. The charge Nos.19–28 in Table 3 contained certain amounts of impurities. The magnetic properties were measured for each strip produced from all of the charges. The measurements were carried out as in Example 3.

It is clear from the results of charge Nos.19–28 in Table 3 that when at least one element falls outside the allowable ranges (such as 0.008 to 0.1 weight % of P, 0.15 to 0.5 weight % of Mn and 0.004 to 0.05 weight % of S), the resulting strip shows core loss of W13/50 greater than 0.12 W/Kg, respectively.

COMPARATIVE EXAMPLE 2

Amorphous strips were produced from the alloys having the composition Fe—$B_{15}Si_6C_1$(atomic %) and the balance comprising impurities. The impurities were P, Mn and S contained in the alloys. Various kinds of alloys having different compositions were cast for the amorphous strip production. The processing conditions were the same as those of Example 3. The strip had a thickness of about 30 μm. Chemical analysis was conducted on all of the charges. The charge Nos. 19–28 in Table 4 contained certain amounts of impurities. The magnetic properties were measured for each strip produced from all of the charges. The measuring condition were the same as those of Example 3.

It is clear from the charge Nos.19–28 in Table 4 that when at least one element falls outside of the allowable range (such as 0.008 to 0.1 weight % of P, 0.15 to 0.5 weight % of Mn and 0.004 to 0.05 weight % of S), the resulting strip shows a core loss value of W13/50 greater than 0.12 W/kg, respectively.

COMPARATIVE EXAMPLE 3

Amorphous strips were produced from the alloys having the composition Fe—$B_{15}Si_{3.5}C_1$(atomic %) and the balance comprising impurities. The impurities were P, Mn and S contained in the alloys. Various kinds of alloys having different compositions were cast for the amorphous strip production. The processing conditions were the same as Example 3. The strips had a thickness of about 30 μm. Chemical analysis was conducted on all of the charges. The charge Nos.19–28 in Table 5 contained certain amounts of impurities. The magnetic properties were measured for each strip produced from all of the charges. The measurement were carried out as in Example 3.

It is clear from the charge Nos.19–28 in Table 5 that when at least one element falls outside the allowable ranges (such as 0.008 to 0.1 weight % of P, 0.15 to 0.5 weight % of mn and 0.004 to 0.05 weight % of S), the resulting strip shows a core loss of W13/50 greater than 0.12 W/kg, respectively.

EXAMPLE 6

Amorphous strips were produced from an alloy composition of Fe—B—Si—C system and further containing 0.018 weight % of P, 0.21 weight % of Mn and 0.006 weight % of S melted in an argon atomosphere and cast by the single roll process in air. The relative amounts of Fe, Si, B and C were varied to observe the relationship between the relative amounts of the constituents and the resulting magnetic properties, where Fe+Si+B+C=100 atomic %. The casting their machine was equipped with a Cu roll having a 580 mm diameter, a power supply for high-frequency induction heating for melting the alloys, a quartz crucible with double slotted nozzles having 0.4 mm width, 25 mm length and a 1 mm slit space therebetween. The cast strip had a thickness of about 50 μm.

The strips were cut into 120 mm lengths, taken from 12 different portions in one lot, and then annealed in a nitrogen gas atomosphere in a magnetic field at a temperature of about 360° C. for 1 hour. The magnetic properties were measured by the SST measuring process at a condition of 1.3 T and 50 Hz as shown in Table 6.

Table 6 shows each value of Wmax and Wmin, and each value of (Wmax−Wmin)/Wmin, where Wmax is the maximum core loss value and Wmin is the minimum core loss value in one lot.

As clearly seen from the results of the charge Nos.1–24 in Table 6, a core loss at a condition of 1.3 T and 50 Hz having below 0.12 W/kg, (Wmax−Wmin)/Wmin≦0.15 and uniform magnetic properties throughout its length can be obtained by limiting the composition to a narrow range of values, containing between more than 80 and 82 atomic % of Fe, between 2 and less than 5 atomic % of Si, between 14 and 16 atomic % of B and between 0.02 and 4 atomic % of C with P, Mn and S as the impurities within the scope of the present invention. On the other hand, the Comparative Example represented by charge Nos.25–34 show increased core loss of more than 0.12 W/kg in some portions, and (Wmax−Wmin)/Wmin≦0.15, and increased brittleness even if (Wmax−Wmin)/Wmin≦0.15 is satisfied.

The above clearly shows that lower quality materials than the conventional materials containing P, Mn and S can be used as the alloy raw materials.

TABLE 6

| Charge No. | | Fe (at. %) | Si (at. %) | B (at. %) | C (at. %) | Wmax (W/kg) | Wmin (W/kg) | Value of Wmax − Wmin/Wmin |
|---|---|---|---|---|---|---|---|---|
| Present invention | 1 | 80.2 | 3.8 | 15.0 | 1.0 | 0.110 | 0.098 | 0.12 |
| | 2 | 80.5 | 3.6 | 14.9 | 1.0 | 0.099 | 0.092 | 0.08 |
| | 3 | 80.7 | 3.7 | 14.8 | 0.8 | 0.115 | 0.101 | 0.14 |
| | 4 | 81.0 | 2.5 | 15.5 | 1.0 | 0.117 | 0.109 | 0.07 |
| | 5 | 81.2 | 2.8 | 15.2 | 0.8 | 0.116 | 0.108 | 0.07 |
| | 6 | 81.5 | 2.6 | 15.1 | 0.8 | 0.119 | 0.110 | 0.08 |
| | 7 | 81.7 | 2.6 | 14.9 | 0.8 | 0.120 | 0.111 | 0.08 |
| | 8 | 82.0 | 2.5 | 14.7 | 0.8 | 0.119 | 0.109 | 0.09 |
| | 9 | 81.5 | 2.0 | 15.5 | 1.0 | 0.114 | 0.101 | 0.13 |
| | 10 | 81.7 | 2.2 | 15.1 | 1.0 | 0.098 | 0.089 | 0.10 |
| | 11 | 80.2 | 4.3 | 14.7 | 0.8 | 0.112 | 0.100 | 0.12 |
| | 12 | 80.3 | 4.5 | 14.4 | 0.8 | 0.109 | 0.101 | 0.08 |
| | 13 | 80.3 | 4.7 | 14.2 | 0.8 | 0.110 | 0.103 | 0.07 |
| | 14 | 80.2 | 4.9 | 14.1 | 0.8 | 0.110 | 0.102 | 0.98 |
| | 15 | 80.3 | 4.9 | 14.0 | 0.8 | 0.112 | 0.100 | 0.12 |
| | 16 | 80.2 | 3.3 | 15.5 | 1.0 | 0.095 | 0.088 | 0.08 |
| | 17 | 80.2 | 3.1 | 16.0 | 0.7 | 0.103 | 0.095 | 0.08 |
| | 18 | 80.48 | 4.0 | 15.5 | 0.02 | 0.104 | 0.094 | 0.11 |
| | 19 | 80.3 | 3.9 | 15.6 | 0.2 | 0.100 | 0.092 | 0.09 |
| | 20 | 80.4 | 3.8 | 15.4 | 0.4 | 0.098 | 0.090 | 0.09 |
| | 21 | 80.6 | 3.0 | 15.2 | 1.2 | 0.109 | 0.102 | 0.07 |
| | 22 | 80.5 | 2.6 | 15.1 | 1.8 | 0.119 | 0.108 | 0.10 |
| | 23 | 80.4 | 2.5 | 14.6 | 2.5 | 0.119 | 0.110 | 0.08 |
| | 24 | 80.2 | 2.1 | 14.1 | 3.6 | 0.120 | 0.111 | 0.08 |
| Comparative | 25 | 78.5 | 5.2 | 15.3 | 1.0 | 0.122 | 0.103 | 0.18 |

TABLE 6-continued

| Charge No. | Fe (at. %) | Si (at. %) | B (at. %) | C (at. %) | Wmax (W/kg) | Wmin (W/kg) | Value of Wmax − Wmin/Wmin |
|---|---|---|---|---|---|---|---|
| 26 | 79.2 | 5.6 | 14.2 | 1.0 | 0.121 | 0.104 | 0.16 |
| 27 | 82.5 | 1.6 | 15.0 | 0.9 | 0.137 | 0.115 | 0.19 |
| 28 | 83.1 | 1.7 | 14.5 | 0.7 | 0.138 | 0.117 | 0.18 |
| 29 | 81.6 | 1.8 | 15.6 | 1.0 | 0.131 | 0.113 | 0.16 |
| 30 | 81.0 | 4.4 | 13.8 | 0.8 | 0.141 | 0.121 | 0.17 |
| 31 | 80.5 | 5.3 | 13.2 | 1.0 | 0.119 | 0.102 | 0.17 |
| 32 | 80.2 | 2.8 | 16.3 | 0.7 | 0.140 | 0.135 | 0.04 |
| 33 | 80.3 | 2.5 | 16.5 | 0.7 | 0.151 | 0.142 | 0.06 |
| 34 | 80.3 | 2.0 | 17.0 | 0.7 | 0.162 | 0.150 | 0.08 |

*Charge Nos. 32–34 show a increased brittleness.

EXAMPLE 7

Amorphous strips were produced by the single roll process. Alloys containing Fe, Si, B and C as main components and having a composition of $Fe_{80.2}Si_{2.3}B_{15.5}C_1$ (atomic %) and further containing various amounts of P, Mn and S as impurities were produced. The casting machine was the same as that used in Example 6. A single slotted nozzle having a 25 mm length and 0.6 mm width was used. The cast strips had a thickness about 35 $\mu$m.

The method for taking the test pieces for evaluating core loss and the testing conditions were the same as those of Example 6. The results are shown in Table 7.

It can be clearly seen that the each strips produced by each charge show the respective contents of P, Mn and S in the range of 0.008 to 0.1 weight %, 0.15 to 0.5 weight % and 0.004 to 0.05 weight i respectively, and show a core loss value of 0.12 W/kg or less, (Wmax−Wmin)/Wmin≦0.15 and uniform magnetic properties throughout its length. On the other hand, the Comparative Examples represented by the charge Nos.16–25 show an increased core loss of more than 0.12 W/Kg in some portions when the contents of at least one element of the P, Mn or S amount falls outside the scope of the present invention. Furthermore, the value of (Wmax−Wmin)/Wmin become larger than 0.15 in the charge Nos.22–25.

It is also clear that the strip produced within the narrow composition ranges of Fe—Si—B—C system alloy of charge No.16, which does not contain impurities because of an electrolytic iron was used, cannot be obtained core loss less than 0.12 W/Kg. The present invention's composition ranges, containing certain amounts of the impurities P, Mn and S only, exihibits lower core loss.

The above show that lower quality materials than the conventional materials containing P,Mn and S can be used as the alloy raw materials.

TABLE 7

| Charge No. | | P (wt. %) | Mn (wt. %) | S (wt. %) | Wmax (W/kg) | Wmin (W/kg) | Value of Wmax − Wmin/Wmin |
|---|---|---|---|---|---|---|---|
| Present invention | 1 | 0.008 | 0.20 | 0.006 | 0.18 | 0.108 | 0.09 |
| | 2 | 0.012 | 0.18 | 0.008 | 0.105 | 0.096 | 0.09 |
| | 3 | 0.016 | 0.21 | 0.007 | 0.098 | 0.092 | 0.07 |
| | 4 | 0.018 | 0.21 | 0.006 | 0.094 | 0.087 | 0.08 |
| | 5 | 0.026 | 0.18 | 0.011 | 0.113 | 0.101 | 0.12 |
| | 6 | 0.030 | 0.29 | 0.009 | 0.119 | 0.106 | 0.12 |
| | 7 | 0.039 | 0.31 | 0.010 | 0.117 | 0.105 | 0.11 |
| | 8 | 0.048 | 0.20 | 0.046 | 0.119 | 0.110 | 0.08 |
| | 9 | 0.053 | 0.48 | 0.047 | 0.118 | 0.108 | 0.09 |
| | 10 | 0.097 | 0.47 | 0.031 | 0.120 | 0.110 | 0.09 |
| | 11 | 0.016 | 0.15 | 0.004 | 0.097 | 0.090 | 0.08 |
| | 12 | 0.017 | 0.17 | 0.023 | 0.106 | 0.099 | 0.07 |
| | 13 | 0.020 | 0.18 | 0.014 | 0.105 | 0.097 | 0.08 |
| | 14 | 0.026 | 0.18 | 0.016 | 0.114 | 0.102 | 0.12 |
| | 15 | 0.018 | 0.23 | 0.005 | 0.100 | 0.093 | 0.08 |
| Comparative | 16 | <0.003 | <0.003 | <0.003 | 0.173 | 0.158 | 0.09 |
| | 17 | 0.005 | 0.16 | 0.905 | 0.132 | 0.121 | 0.09 |
| | 18 | 0.007 | 0.21 | 0.006 | 0.135 | 0.120 | 0.13 |
| | 19 | 0.103 | 0.22 | 0.094 | 0.134 | 0.126 | 0.06 |
| | 20 | 0.110 | 0.16 | 0.008 | 0.137 | 0.123 | 0.11 |
| | 21 | 0.018 | 0.53 | 0.011 | 0.143 | 0.126 | 0.13 |
| | 22 | 0.019 | 0.58 | 0.009 | 0.153 | 0.127 | 0.20 |
| | 23 | 0.018 | 0.20 | 0.053 | 0.148 | 0.125 | 0.18 |
| | 24 | 0.095 | 0.21 | 0.059 | 0.167 | 0.135 | 0.24 |
| | 25 | 0.097 | 0.52 | 0.055 | 0.171 | 0.137 | 0.25 |

EXAMPLE 8

Amorphous strips were produced, using steel produced by a normal steel making process as an iron raw material, by a single roll process the same as that of Example 6. The iron raw material contained 0.0033 weight % of C, 0.82 weight % of Si, 0.0178 weight % of P, 0.21 weight % of Mn, 0.006 weight % of S and the balance Fe. The resultant strip composition was $Fe_{80.4}$—$B_{15.4}$ $Si_{3.2}C_{1.0}$(atomic %) and further contained various amounts of P, Mn and S as impurities, such as 0.017 weight % of P, 0.20 weight % of Mn and 0.005 weight % of S. The cast strip had a thickness of about 50 $\mu$m.

The resultant strip exhibited 0.094 W/kg as the maximum core loss (Wmax), 0.088 W/kg of the minimum core loss (Wmin) and the value (Wmax−Wmin)/Wmin was 0.07, and showed uniform properties throughout its length.

From the above, it is clearly seen that lower quality materials than the conventionally used materials containing P, Mn and S can be used as the alloy raw materials.

We claim:

1. An electric power transformer core having enhanced AC magnetic properties, said electric power transformer core formed from an amorphous metal strip consisting essentially of a composition mainly composed of Fe, Si, B and C having the formula wherein "a", "b", "c" and "d" are atomic percentages ranging between more than 80 and 82; 2 and less than 5; 14 and 16; and 0.02 and 4; respectively, with the proviso that the sum of "a", "b", "c" and "d" is equal to 100, and further containing P, Mn, and S in weight percentages ranging from 0.008 to 0.1, 0.15 to 0.5 and 0.004 to 0.05, respectively, whereby the enhanced magnetic properties of said amorphous metal alloy strip include a core loss in a single cut sheet of not more than 0.12 W/Kg measured at a frequency of 50 Hz and a magnetic flux density of 1.3 T (Tesla).

2. A high frequency electrical transformer core having enhanced AC cagrientir properties, said high frequency electrical transformer core formed from an amorphous metal strip consisting essentially of a composition mainly composed of Fe, Si, B and C having the formula wherein "a", "b", "c" and "d" are atomic percentages ranging between more than 80 and 82; 2 and less than 5; 14 and 16; and 0.02 and 4; respectively, with the proviso that the sum of "a", "b", "c" and "d" is equal to 100, and further containing P, Mn, and S in weight percentages ranging from 0.008 to 0.1, 0.15 to 0.5 and 0.004 to 0.05, respectively, whereby the enhanced magnetic properties of said amorphous metal alloy strip include a core loss in a single cut sheet of not more than 0.12 W/Kg measured at a frequency of 50 Hz and a magnetic flux density of 1.3 T (Tesla).

3. An electric power transformer core according to claim 1 wherein said amorphous metal strip has a core loss in a single cut strip of not more than 0.15 in accordance with the formula (Wmax−Wmin)/Wmin, where Wmax is the maximum value of core loss and Wmin is the minimum value of core loss measured at a frequency of 50 Hz and a magnetic flux density of 1.3 T (Tesla).

4. A high frequency electrical transformer core according to claim 2 wherein said amorphous metal strip has a core loss in a single cut strip of not more than 0.15 in accordance with the formula (Wmax−Wmin)/Wmin, where Wmax is the maximum value of core loss and Wmin is the minimum value of core loss measured at a frequency of 50 Hz and a magnetic flux density of 1.3 T (Tesla).

* * * * *

UNITED STATES PATENT AND TRADEMARK OFFICE

CERTIFICATE OF CORRECTION

PATENT NO. : 5,958,153
DATED : September 28, 1999
INVENTOR(S) : Hiroaki Sakamoto, et al.

It is certified that error appears in the above-identified patent and that said Letters Patent is hereby corrected as shown below:

Column 1,
Line 67, change "impurities,i.e." to -- impurities i.e. --.

Column 2,
Line 57, after "0.1" insert a comma.
Line 57, change "umore" to -- more --.

Column 3,
Line 56, change "P,Mn" to -- P, MN --.

Column 4,
Line 61, change "400° (was ..." to -- 400°c was. . . --.

Column 6,
Line 65, change "mesuring" to -- measuring --.
Line 66, insert a period after "atmsosphere".
Line 67, delete period before -- Relating --.

Column 7,
Line 15, after "achieved" insert -- and --.

Column 9,
line 44, "with the. . ." should continue on line 43 after "crucible".

UNITED STATES PATENT AND TRADEMARK OFFICE

CERTIFICATE OF CORRECTION

PATENT NO. : 5,958,153
DATED : September 28, 1999
INVENTOR(S) : Hiroaki Sakamoto, et al.

It is certified that error appears in the above-identified patent and that said Letters Patent is hereby corrected as shown below:

Column 18,
Line 3, after "formula" insert -- ($Fe_a$ $Si_b$ $B_c$ $C_D$) --.

Signed and Sealed this

Seventh Day of August, 2001

Nicholas P. Godici

*Attest:*

*Attesting Officer*

NICHOLAS P. GODICI
*Acting Director of the United States Patent and Trademark Office*